United States Patent [19]

Kataczynski

[11] Patent Number: 4,566,588

[45] Date of Patent: Jan. 28, 1986

[54] AMMUNITION STORAGE SYSTEM AND CONTAINER FOR USE THEREIN

[75] Inventor: Nachman Kataczynski, Natanya, Israel

[73] Assignee: Urdan Industries Ltd., Natanya, Israel

[21] Appl. No.: 548,036

[22] Filed: Nov. 2, 1983

Related U.S. Application Data

[63] Continuation of Ser. No. 356,356, Mar. 9, 1982.

[30] Foreign Application Priority Data

Mar. 20, 1981 [IL] Israel ..... 62441

[51] Int. Cl.[4] ..... F42B 37/00

[52] U.S. Cl. ..... 206/3; 206/597; 206/511; 206/523; 206/585; 206/586

[58] Field of Search ..... 206/3, 386, 523, 597, 206/511, 512, 509, 523, 585, 586

[56] References Cited

U.S. PATENT DOCUMENTS

| | | | |
|---|---|---|---|
| 1,218,814 | 3/1917 | Steinmetz | 206/3 |
| 2,792,962 | 5/1957 | Granfelt | 206/3 |
| 3,288,311 | 11/1966 | Beattie | 206/597 |
| 3,481,502 | 12/1969 | Slayman | 206/511 |
| 3,830,380 | 8/1974 | Spencer | 206/386 |
| 3,981,410 | 9/1976 | Schurch | 206/511 |
| 4,015,714 | 4/1977 | Silver et al. | 206/511 |
| 4,139,097 | 2/1979 | Bowman et al. | 206/511 |
| 4,195,732 | 4/1980 | Bell | 206/597 |
| 4,279,339 | 7/1981 | Gotter | 206/3 |
| 4,306,601 | 12/1981 | Wallis et al. | 206/523 |

FOREIGN PATENT DOCUMENTS

| | | | |
|---|---|---|---|
| 930468 | 4/1947 | France | 206/3 |
| 1423797 | 11/1965 | France | 206/3 |
| 2351379 | 7/1975 | France | 206/3 |
| 314770 | 6/1929 | United Kingdom | 206/3 |
| 765992 | 1/1957 | United Kingdom | 206/597 |
| 719925 | 3/1980 | U.S.S.R. | 206/3 |

*Primary Examiner*—Joseph Man-Fu Moy

*Attorney, Agent, or Firm*—Benjamin J. Barish

[57] ABSTRACT

An ammunition storage system includes a plurality of like containers each having two internal compartments for receiving two rounds of ammunition in side-by-side relationship, the upper and lower faces of each container being formed with complementary nesting elements permitting a plurality of like containers to be stacked in nested relationship and secured together to form a multi-layer honeycomb construction for a plurality of ammunition rounds. Each container is constructed with an outer rigid plastic housing, an inner liner for each compartment, and a cushioning body of foamed plastics material surrounding each of the liners.

14 Claims, 4 Drawing Figures

FIG. 1
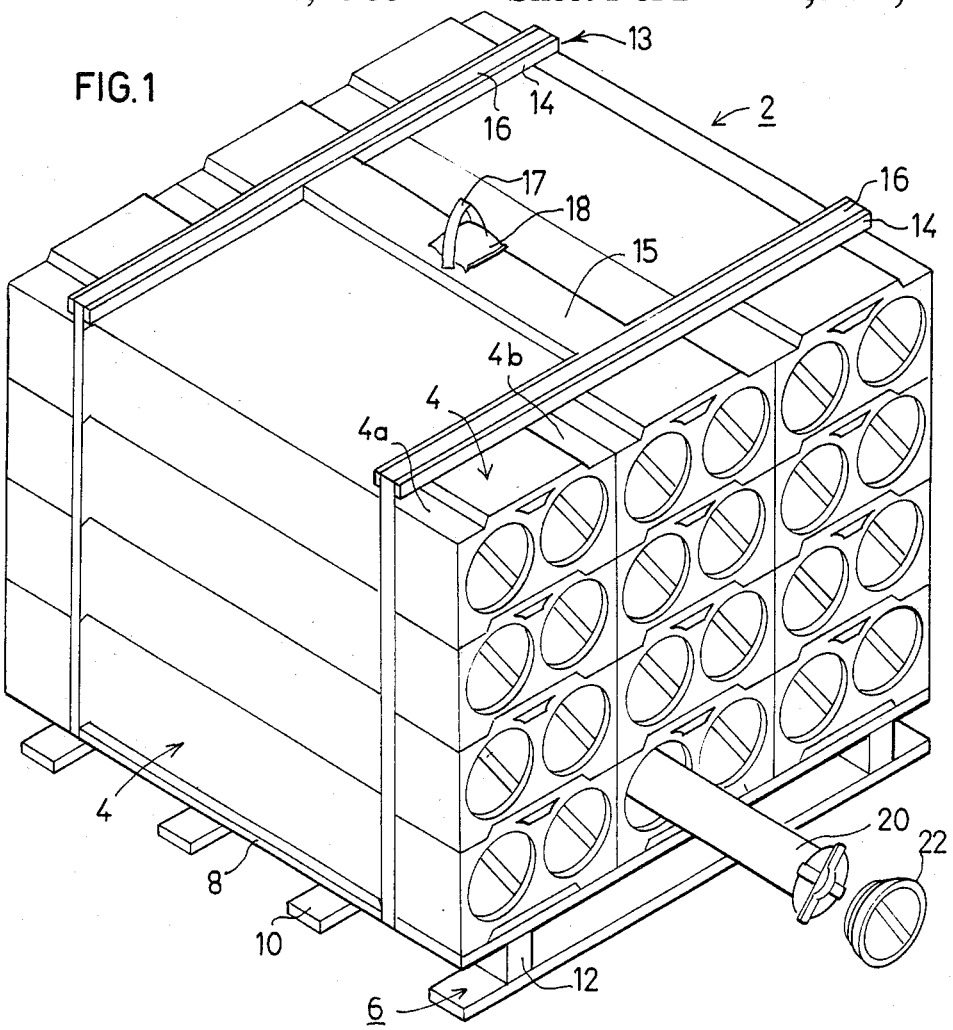
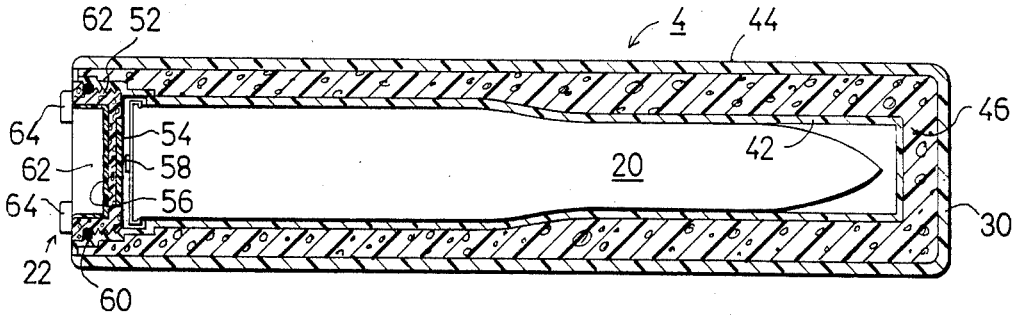
FIG. 3

AMMUNITION STORAGE SYSTEM AND CONTAINER FOR USE THEREIN

This application is a continuation of application Ser. No. 356,356 filed Mar. 9, 1982.

BACKGROUND OF THE INVENTION

The present invention relates generally to ammunition storage containers, and also to ammunition storage systems including such containers.

Several types of ammunition storage containers are presently used to transport and store ammunition in tanks and other forms of armored vehicles. The most common type of container is simply a wooden box in which one or two rounds of ammunition are packed, each individual round being wrapped by a cardboard cylinder. The wooden boxes are usually stored in packs of 12 or more on standard pallets. Such an arrangement, however, is far from satisfactory, since it requires considerable labor and time to transfer ammunition stores to the individual armored vehicles. Thus, the wooden boxes first have to be de-palletized by separating and removing each of the individual boxes from the pallet; each box then has to be opened; the cardboard cylinders containing the ammunition rounds have to be removed; finally, the cardboard cylinders, which are usually sealed by a self-adhesive tape, have to be opened in order to permit removal of the individual ammunition rounds. Moreover, this arrangement provides a low degree of protection against damage during handling, as the boxes are easily broken if dropped. Also, the existing containers offer very little protection against fire since the wooden boxes burn easily. They also offer very little protection against penetration of water, such as may occur in prolonged outside exposure during adverse weather conditions. Finally, these known containers are not well adapted for the internal ammunition storage racks in tanks or other armored vehicles.

More recently, another type of ammunition storage container has been developed offering a higher degree of fire protection than the conventional containers. One of the disadvantages of this more recent container, however, is that, it is large and heavy, being adapted to contain four ammunition rounds, and therefore is not easily adaptable for transporting ammunition outside the armored vehicle. Moreover, it offers little protection against the penetration of water.

BRIEF SUMMARY OF THE INVENTION

An object of the present invention is to provide an ammunition storage system and also an ammunition storage container having advantages in one or more of the above respects.

According to the present invention, there is provided an ammunition storage system which facilitates the transportation to a vehicle of a plurality of rounds of ammunition and the storage in the vehicle of the rounds of ammunition in condition for immediate individual use. More particularly, the storage system includes a supporting pallet and a plurality of like containers in stacked relationship on the supporting pallet and arranged in a plurality of vertical columns and horizontal rows to form a multi-layer honeycomb construction, each container having at least one internal compartment configured to receive a round of ammunition. The lower face of each container is formed with a foot at each end, and the upper face of each container is formed with a socket at each end having a configuration to nestably receive the foot of another like container and to prevent both sidewise and longitudinal movements between them. The storage system further includes a strap applied circumferentially around an intermediate portion of the containers and supporting pallet to secure them in the honeycomb construction. This arrangement not only facilitates the transportation to the vehicle of the plurality of rounds of ammunition, but also facilitates their storage within the vehicle in a condition providing a high degree of individual protection because of the cushioning effects of the honeycomb construction, and further, it facilitates the individual use of the ammunition rounds by their individual removal from one end of the respective containers in the honeycomb construction.

In the preferred embodiment of the invention described below, each of the containers is divided into at least two internal compartments for receiving two rounds of ammunition in side-by-side relationship. The optimum arrangement is one wherein the container is divided into two compartments each for receiving one round of ammunition.

Ammunition storage containers constructed in accordance with the foregoing features will be seen to provide the above and other important advantages. Thus, the honeycomb construction formed by the plurality of stacked, nested containers enables the stack to be opened from one side and the individual ammunition to be separately removed as needed, thereby avoiding the time and effort to unload a stack of containers from a pallet in order to remove individual ammunition. Further, the honeycomb construction is better capable of absorbing severe shock as a result of rough handling, thereby providing a higher degree of mechanical protection to the ammunition. The nesting arrangement of the containers, wherein they are nested against both sidewise and longitudinal movements with respect to each other, also enables more compact and more stable packing of the individual containers such as to facilitate not only removal of the individual containers and ammunition rounds when needed, but also to facilitate the transportation of the ammunition to the armored vehicle and its storage within the vehicle.

The novel container construction and system of the present invention provides a number of further advantages, as will be described more particularly below. Thus, the individual containers may include sealing arrangements which make them substantially waterproof and water-tight. In addition, they may be made of material having properties providing a high degree of fire protection.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a three-dimensional view illustrating a stack of nested ammunition storage containers constructed in accordance with the invention;

FIG. 3 is a longitudinal sectional view illustrating the construction of the container of FIG. 2.

DESCRIPTION OF A PREFERRED EMBODIMENT

Figure 2:
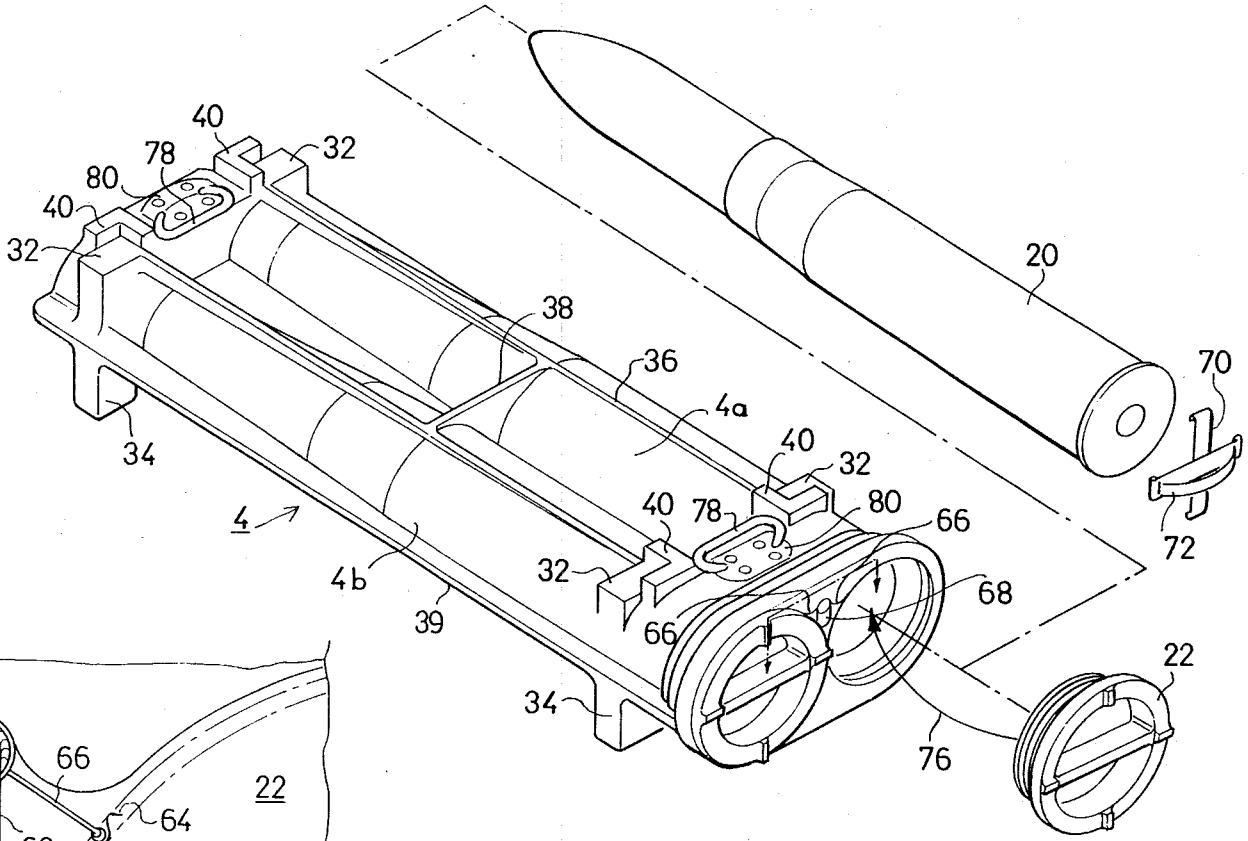
FIG. 2 is a three-dimensional, exploded view illustrating one of the containers in the stack of FIG. 1, and further illustrating one of the two ammunition rounds adapted to be accommodated by the individual container.

With reference first to FIG. 1, there is illustrated a container stack, generally designated 2, including a plurality of containers 4 in stacked, nested relationship, one on top of the other, to form a plurality of vertical columns and horizontal rows. In FIG. 1, there are three vertical columns and four horizontal rows, thereby totalling twelve containers 4 in the stack 2. These twelve containers are stacked on a wooden pallet 6 including a horizontal supporting panel 8 secured to a plurality of parallel bottom boards 10 via a plurality of cross-boards 12, such that the lower face of the supporting panel 8 is spaced above the ground or other supporting surface.

A further panel 13 is provided at the upper end of the container stack, this panel being of H-shape configuration and including a pair of parallel legs 14 extending transversely across the ends of the containers 4 in the stack, and a bridging leg 15 extending across the two legs 14 at an intermediate location thereof and parallel to the axis of the middle column of containers 4 in the stack.

The containers 4 are secured together in the stack by a pair of straps 16, e.g. of steel, enclosing the opposite ends of the container stack 2. Thus, each strap is applied to underlie the supporting panel 8 of pallet 6 and to overlie one of the legs 14 of the upper panel 13. The middle leg 15 of the upper panel 13 is provided with a hook 17 secured, e.g. by a plate 18, to the bridging leg 15 of the upper panel 13 to facilitate the handling and transportation of the palletized stack of containers 4.

Each of the containers 4 in the stack 2 is divided into two sections 4*a*, 4*b*, defining two compartments in side-by-side relationship. Each compartment is adapted to receive one ammunition round 20 and is closed by a removable cover 22. Thus, the container stack illustrated in FIG. 1, being constituted of 12 two-compartment containers, can accommodate 24 ammunition rounds.

The configuration of each of the containers 4 is more particularly illustrated in the three-dimensional view of FIG. 2, and its structure is more particularly illustrated in the sectional view of FIG. 3.

Thus, as shown in FIG. 2, each of the two sections 4*a*, 4*b* includes an internal compartment configured for receiving one ammunition round 20. The end of each compartment opposite to that closed by its cover 22 is closed by the container end wall 30. The outer face of each of the two sections 4*a*, 4*b* is of generally cylindrical configuration approximating that of its compartment. However, both the upper and lower faces of the container are laterally extended at their opposite ends to form four substantially flat-topped posts 32 of rectangular section at the four upper corners of the container, and four similar substantially flat-topped posts 34 of rectangular section at the four lower corners of the container. For strengthening purposes, these posts 32, 34, are connected together by longitudinally-extending ribs 36. These ribs, integrally formed with the two container sections 4*a*, 4*b*, are also connected together by one or more transversely-extending ribs 38 on both the upper and lower faces of the container. Further strengthening ribs 39 are formed on the opposite sides of the container and extend the complete length thereof between the upper-face posts 32 and the lower-face posts 34.

The upper face of the container is further formed with four L-shaped projections 40 each extending upwardly from one of the corners of the four posts 32. These L-shaped projections 40 thus define sockets with their underlying posts 32, while the lower-face posts 34 define feet which are nestably receivable in these sockets of another like container, thereby permitting a plurality of such containers to be stacked one on top of the other in a stable, nested relationship as illustrated in FIG. 1. It will be appreciated that these sockets formed on the lower faces of the containers nestably receive the feet or posts 34 formed on the upper faces of the containers in such manner as to prevent both sidewise and longitudinal movements of the containers with respect to each other.

The structure of each container 4 is more particularly illustrated in FIG. 3, where it will be seen that it includes an inner liner 42 for each of the two internal compartments of the two container sections 4*a*, 4*b*, and an outer rigid housing 44 which is common to both of the container sections 4*a*, 4*b* and defines the configuration of the outer face of the container as described above. The container further includes a cushioning body 46 surrounding both of the liners 42 and enclosed by the outer housing section 44. Preferably, both the inner liners 42, and the outer housing 44 are made of glass-reinforced plastic material, such as glass-reinforced polyester, while the cushioning layer 46 is preferably of foamed plastic, such as foamed polyurethane plastic.

For fire protection purposes, each inner liner 42 is preferably coated with a layer of alumina trihydrate. This material may also be applied to the plastic of the other layers.

As one example, the plastic liners 42 may be of 2 mm glass-reinforced polyester sheet having 27% alumina trihydrate by weight of the polyester; each liner 42 may be provided with a 4 mm alumina trihydrate layer bonded by means of 5% (by weight) of phenolic resin; the cushioning body 46 may be 20–35 mm commercial grade polyurethane elastomer with 4% (by weight) of alumina trihydrate; and the outer housing layer 44 may be of the same material as the liners 42.

The covers 22 are preferably attached by threading. They are therefore formed with external threads 52 cooperable with internal threads formed at the respective ends of each of the two sections 4*a*, 4*b* of the container 4. The covers 22 may also be of the same three-layer construction as the container itself, namely an inner plastic liner 54, an outer plastic layer 56, and an intermediate layer 58 of cushioning material. Other materials and constructions, of course, may be used for the covers 22.

Each cover 22 includes a sealing ring 60 along its outer circumference effective, when the cover is applied to close its compartment, to prevent the penetration of water or moisture into the compartment and thereby to protect the ammunition round from water or moisture. In addition, each cover is formed with a diametrically-extending rib 62 to facilitate its manual rotation, and is further formed with a pair of diametrically-opposed projections 64 which project axially outwardly of the cover, to enable a rod-shaped member, such as the shank of a screwdriver, to be applied for facilitating the manual rotation of the cover.

Figure 4:
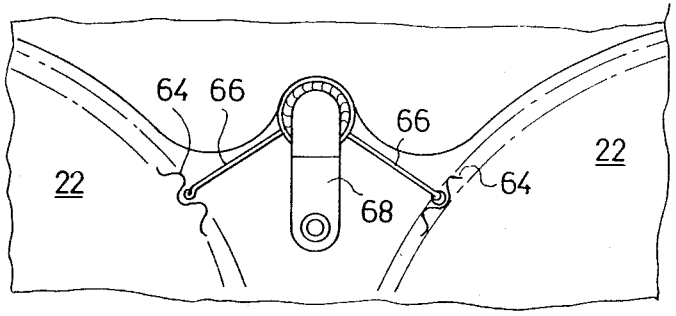
FIG. 4 is an enlarged fragmentary view illustrating a detail in the construction of the container of FIG. 2.

In order to prevent unintentional rotation of the cover, (e.g. by vibration while it is being carried in the armored vehicle), the outer rim of the cover is serrated, as shown at 64 in FIG. 4, and the container is provided with a spring-urged finger 66 bearing against the serrations. Finger 66 is in the form of a leaf spring which is retained, by lug 68, in a V-shaped notch formed at the upper end of the midline of the housing end wall receiving the two covers 22, such that the two ends of the leaf spring 66 are spring-urged against the serrations 64 formed in the rims of the two covers 22.

In addition, an X-shaped pressure element 70 (FIG. 2) including a bowed leaf-spring 72 is interposed between the end of the ammunition round within its housing compartment and the removable cover 22 closing it. Thus, when cover 22 is applied to close the compartment, it engages leaf-spring 72, causing same to apply pressure via the pressure element 70 against the end of the ammunition round, thereby immobilizing same against movement during its transportation or storage.

Further, each cover 22 is secured to its container 4 by means of a plastic cord 76, e.g. of nylon, one end of the cord 76 being bonded to the inner face of the cover, and the opposite end of the cord being bonded to the inner face of its respective liner 42. This arrangement permits removal of the cover in order to remove the ammunition round within the respective compartment, but prevents loss of the cover under field conditions.

Finally, a handle 78 is pivotably mounted by means of a mounting plate 80, to the upper face at each end of the container 4, to facilitate the removal and handling of the individual containers.

While the invention has been described with respect to one preferred embodiment, it will be appreciated that many other variations, modifications and applications of the invention may be made.

What is claimed is:

1. An ammunition storage system including a supporting pallet, a plurality of like containers in stacked relationship on said supporting pallet and arranged in a plurality of vertical columns and horizontal rows to form a multi-layer honeycomb construction, each container having at least one internal compartment configured to receive a round of ammunition, the lower face of each container being formed with a foot at each end, and the upper face of each container being formed with a socket at each end of a configuration to nestably receive the foot of another like container and to prevent both sidewise and longitudinal movements therebetween, and a strap applied circumferentially around an intermediate portion of said containers and supporting pallet to secure them in said honeycomb construction, thereby facilitating: the transportation to the vehicle of the plurality of rounds of ammunition, their storage within the vehicle in a condition providing a high degree of mechanical protection because of the cushioning effect of the honeycomb construction, and the individual use of the ammunition rounds by their individual removal from one end of their respective containers in the honeycomb construction.

2. The system according to claim 1, wherein there is a foot of rectangular section formed at each corner of the lower face of each container, and a socket formed at each corner of the upper face of each container of a configuration to receive the feet and to prevent both sidewise and longitudinal movements between the two containers.

3. The system according to claim 1, wherein each of said containers is divided into two internal compartments and is closed at one end by a common end wall, and at the opposite end by a removable cover for each of the compartments.

4. The system according to claim 1, wherein said stacked and strap-secured containers further include an upper panel overlying the uppermost containers in the stack, said straps being applied around said supporting pallet and upper panel.

5. The system according to claim 4, wherein said upper panel is of H-configuration, including a pair of parallel legs extending transversely across all the columns in the stack at the opposite ends of the stack, and a bridging leg extending parallel to the middle column in the stack, said straps being applied around said pair of parallel legs.

6. The system according to claim 1, wherein each of said containers includes an inner plastic liner for each compartment, and a cushioning body of foamed plastic surrounding each of said plastic liners.

7. The system or container according to claim 6, wherein each of said containers further includes an outer rigid plastic housing surrounding said foamed plastic cushioning body.

8. The system or container according to claim 7, wherein each of said inner liners and said outer rigid housing are made of glass-reinforced plastic.

9. The system or container according to claim 6, wherein each of said inner plastic liners is coated with a fire-protection layer.

10. The system according to claim 3, wherein each of said covers includes sealing means for sealing the interior of its respective compartment against the penetration of moisture.

11. The system according to claim 10, wherein each of said covers is threadedly attached to the container and includes a serrated rim, said container including a spring-urged finger bearing against said serrated rim of the cover for preventing unintentional rotation of the cover by vibration.

12. The system according to claim 11, wherein each of said covers includes diametrically-opposed projections projecting axially from its outer face to enable the application of a rod-shaped member between such projections to facilitate the manual rotation of the cover.

13. The system according to claim 10, wherein each of said covers is carried at one end of a plastic cord, the opposite end of which cord is secured to the container to prevent the loss of the cover after having been unthreaded from its container.

14. The system according to claim 10, further including a spring element adapted to be interposed between the cover and the round of ammunition in its respective compartment for immobilizing the latter against movement within the compartment.

* * * * *